US011905075B2

(12) United States Patent
Chen

(10) Patent No.: US 11,905,075 B2
(45) Date of Patent: Feb. 20, 2024

(54) TAMPER-EVIDENT CONTAINER

(71) Applicant: Kuei-Huan Chen, Taipei (TW)

(72) Inventor: Kuei-Huan Chen, Taipei (TW)

( * ) Notice: Subject to any disclaimer, the term of this patent is extended or adjusted under 35 U.S.C. 154(b) by 0 days.

(21) Appl. No.: 17/218,500

(22) Filed: Mar. 31, 2021

(65) Prior Publication Data

US 2021/0316911 A1 Oct. 14, 2021

(30) Foreign Application Priority Data

Apr. 13, 2020 (TW) ..... 109204266

(51) Int. Cl.
*B65D 43/02* (2006.01)
*B65D 43/16* (2006.01)
*B65D 51/24* (2006.01)

(52) U.S. Cl.
CPC ..... *B65D 43/0262* (2013.01); *B65D 43/0235* (2013.01); *B65D 43/162* (2013.01); *B65D 51/247* (2013.01); *B65D 2543/0049* (2013.01); *B65D 2543/00083* (2013.01); *B65D 2543/00092* (2013.01); *B65D 2543/00194* (2013.01); *B65D 2543/00527* (2013.01); *B65D 2543/00537* (2013.01); *B65D 2543/00648* (2013.01); *B65D 2543/00685* (2013.01); *B65D 2543/00759* (2013.01); *B65D 2543/00796* (2013.01); *B65D 2543/00851* (2013.01)

(58) Field of Classification Search
CPC ..... B65D 43/0254; B65D 2543/00509; B65D 2543/00648; B65D 43/0262
See application file for complete search history.

(56) References Cited

U.S. PATENT DOCUMENTS 5,511,679 A * 4/1996 Beck ..... B65D 43/026 215/354
5,511,680 A * 4/1996 Kinne ..... B65D 17/4011 220/791
7,124,910 B2 * 10/2006 Nordland ..... B65D 75/22 220/4.23
2003/0183636 A1 * 10/2003 Shih ..... B65D 43/0218 220/359.1
2006/0278652 A1 * 12/2006 Vovan ..... B65D 43/0254 220/276

FOREIGN PATENT DOCUMENTS

TW M581097 7/2019

* cited by examiner

*Primary Examiner* — Jeffrey R Allen

(57) ABSTRACT

A tamper-evident container including: a container body having a first hollow convex loop on a periphery of an opening thereof; and a lid having a second hollow convex loop and a force application structure, where the second hollow convex loop is used to engage with the first hollow convex loop, and a loop-shaped breakable line is provided on a loop-shaped top surface of the second hollow convex loop; where, when an illegitimate user applies a lifting force on any local area of the second hollow convex loop of the lid to make the local area moving upward with a displacement exceeding a threshold, a corresponding local area of the loop-shaped breakable line will be broken to show that the tamper-evident container has been tampered with.

5 Claims, 9 Drawing Sheets

TAMPER-EVIDENT CONTAINER

BACKGROUND OF THE INVENTION

Field of the Invention

This invention is related to food delivery containers, especially to tamper-evident containers.

Description of the Related Art

In modern industrial and commercial societies, people's diet habits have changed a lot, the most obvious of which is the substantial increase in the eating-out population. For the eating-out population, lunch container or fast food is the most convenient and economical way of serving a meal. In addition, due to the current global epidemic, not only the eating-out population, but many families are gradually relying on food delivery services to reduce going out.

However, recently there have been occasional cases of delivery persons stealing or tampeloop with meals, which not only cause panic to consumers, but also affect the reputation of delivery service platforms and meal providers.

To solve this problem, Taiwan Patent No. M581097 discloses a tamper-evident container for lunch container, which is characterized in that: when a customer receives a meal delivery using the lunch container, the consumer can determine whether the meal delivery has been tampered with by checking if an identification piece on the outer periphery of the lunch container is intact.

However, as the identification piece is located on the outer periphery of the lunch container, therefore, the identification piece is likely to be hit to cause the breakable line thereof to break duloop the operations of prepaloop and transporting the meal delivery using the lunch container, resulting in a situation that the customer will assume the meal delivery has been tampered, thereby affecting the reputation of the business.

Therefore, there is an urgent need in the field for a novel tamper-evident container.

SUMMARY OF THE INVENTION

One objective of the invention is to disclose a tamper-evident container, which, by installing a loop-shaped breakable line around the periphery of the container, can leave evidence at any part of the periphery of the container when that part of the periphery is opened by an illegitimate person.

Another objective of the present invention is to disclose a tamper-evident container, which can facilitate a legitimate user to open a lid of the container by providing a force application structure in the middle area of the lid for the legitimate user to apply a longitudinal force thereon to break the loop-shaped breakable line to open the lid.

Still another objective of the invention is to disclose a tamper-evident container, which can let the main part of the lid be able to rest on and lid the opening of the container body after the loop-shaped breakable line is broken and the periphery part of the lid outside the loop-shaped breakable line is removed.

To attain the aforementioned objectives, a tamper-evident container is proposed, which includes:

a container body having a first hollow convex loop on a periphery of an opening thereof; and a lid having a second hollow convex loop and a force application structure, where the second hollow convex loop is used to engage with the first hollow convex loop, the force application structure is located in an area surrounded by the second hollow convex loop, and a loop-shaped breakable line is provided on a loop-shaped top surface of the second hollow convex loop;

where, when in a normal opening operation, the force application structure is used for a user to apply a longitudinal force of pull or press thereon to break the loop-shaped breakable line, so that an area enclosed by the loop-shaped breakable line can be removed from the lid; and when an illegitimate user applies a lifting force on any local area of the second hollow convex loop of the lid to make the local area moving upward with a displacement exceeding a threshold, a corresponding local area of the loop-shaped breakable line will be broken to show that the tamper-evident container has been tampered with.

In one embodiment, the lid is made of plastic.

In one embodiment, the container body is made of plastic.

In one embodiment, the container body is transparent.

In one embodiment, the container body has a shape of circle or polygon.

To make it easier for our examiner to understand the objective of the invention, its structure, innovative features, and performance, we use preferred embodiments together with the accompanying drawings for the detailed description of the invention.

DETAILED DESCRIPTION OF THE PREFERRED EMBODIMENTS

Figure 1:
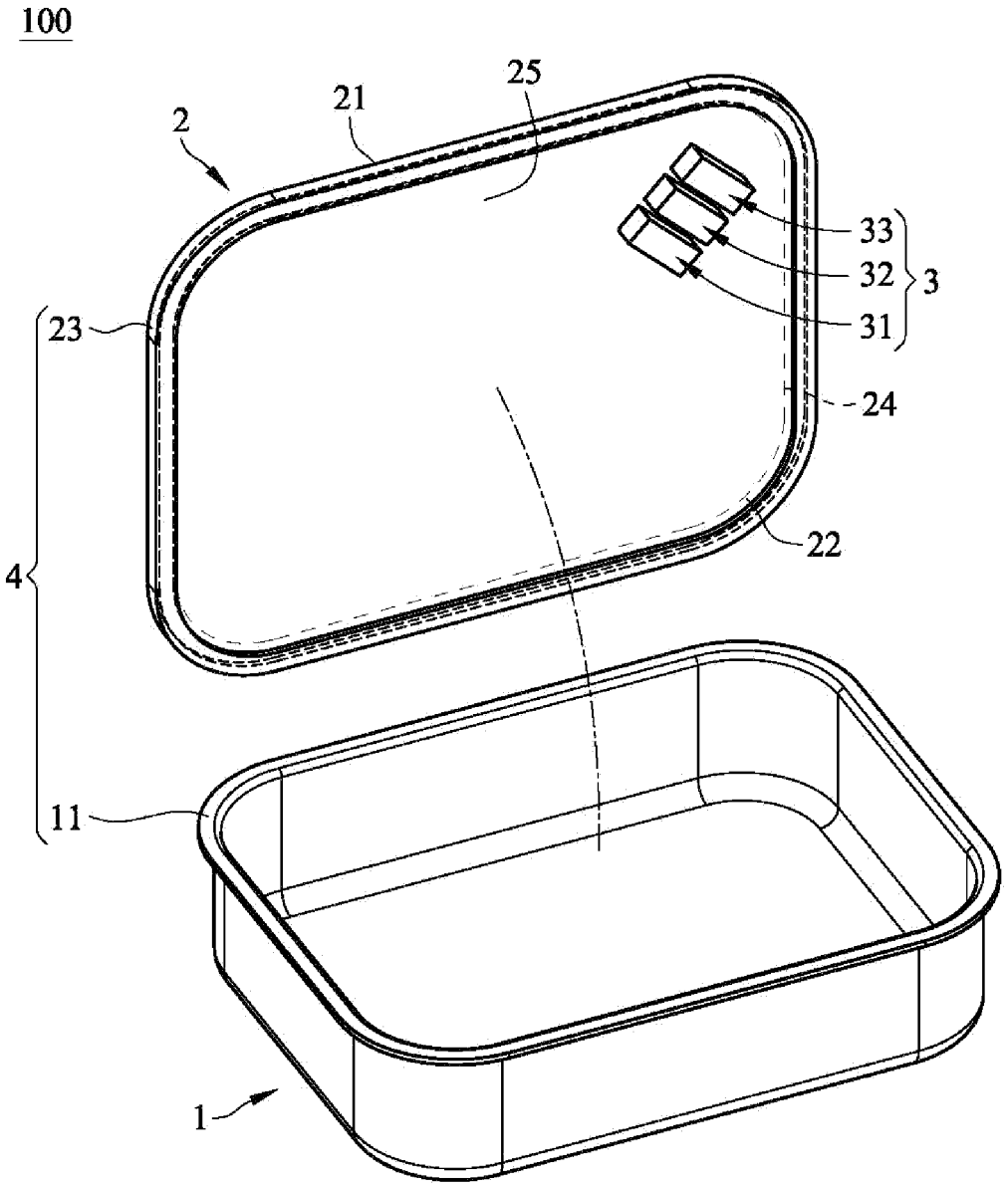
FIG. 1 illustrates a schematic diagram of an embodiment of the tamper-evident container of the invention.
Figure 2:
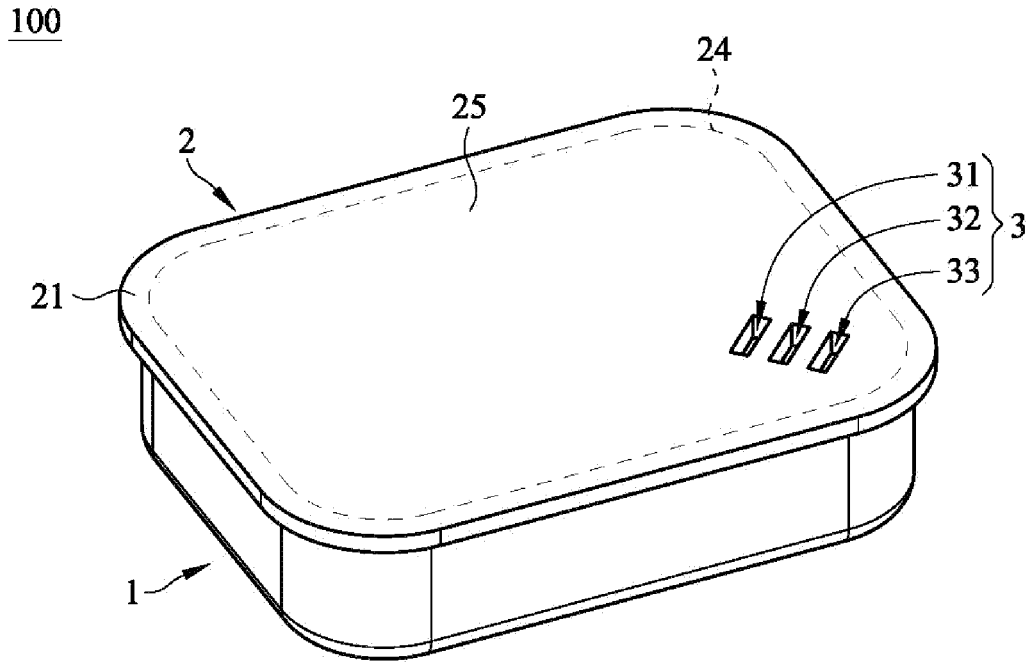
FIG. 2 illustrates another schematic diagram of the tamper-evident container shown in FIG. 1.
Figure 3:
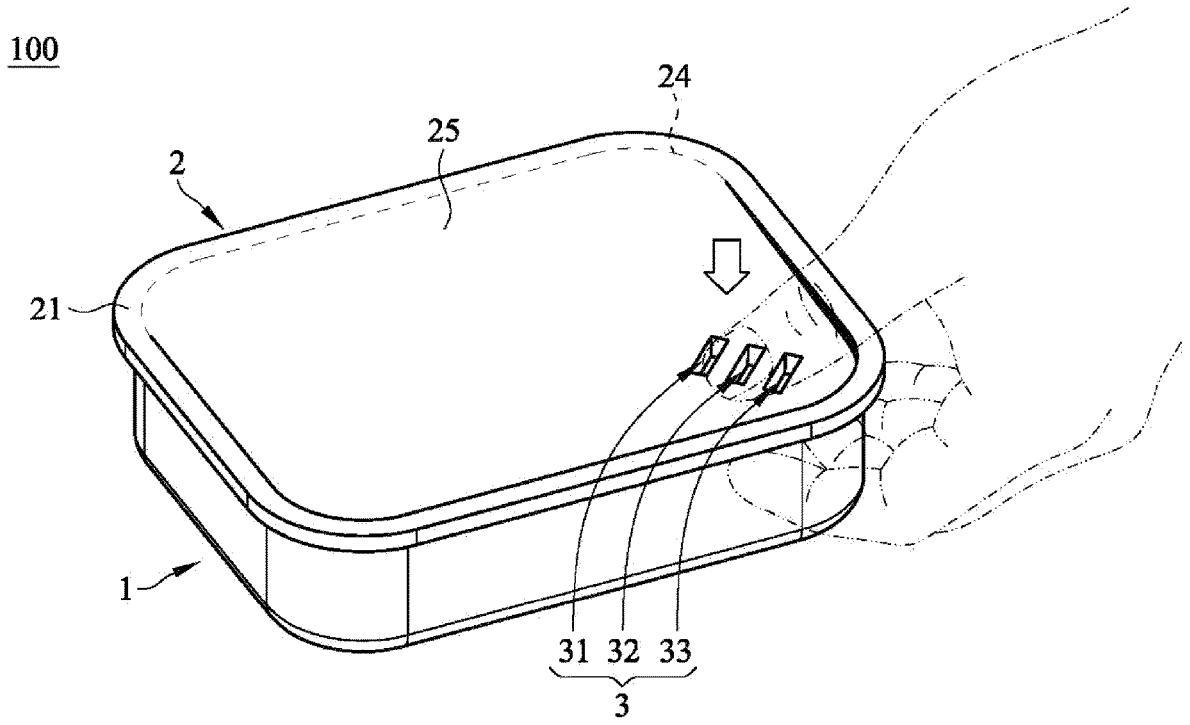
FIG. 3 illustrates an in-use state of the tamper-evident container shown in FIG. 1.
Figure 4:
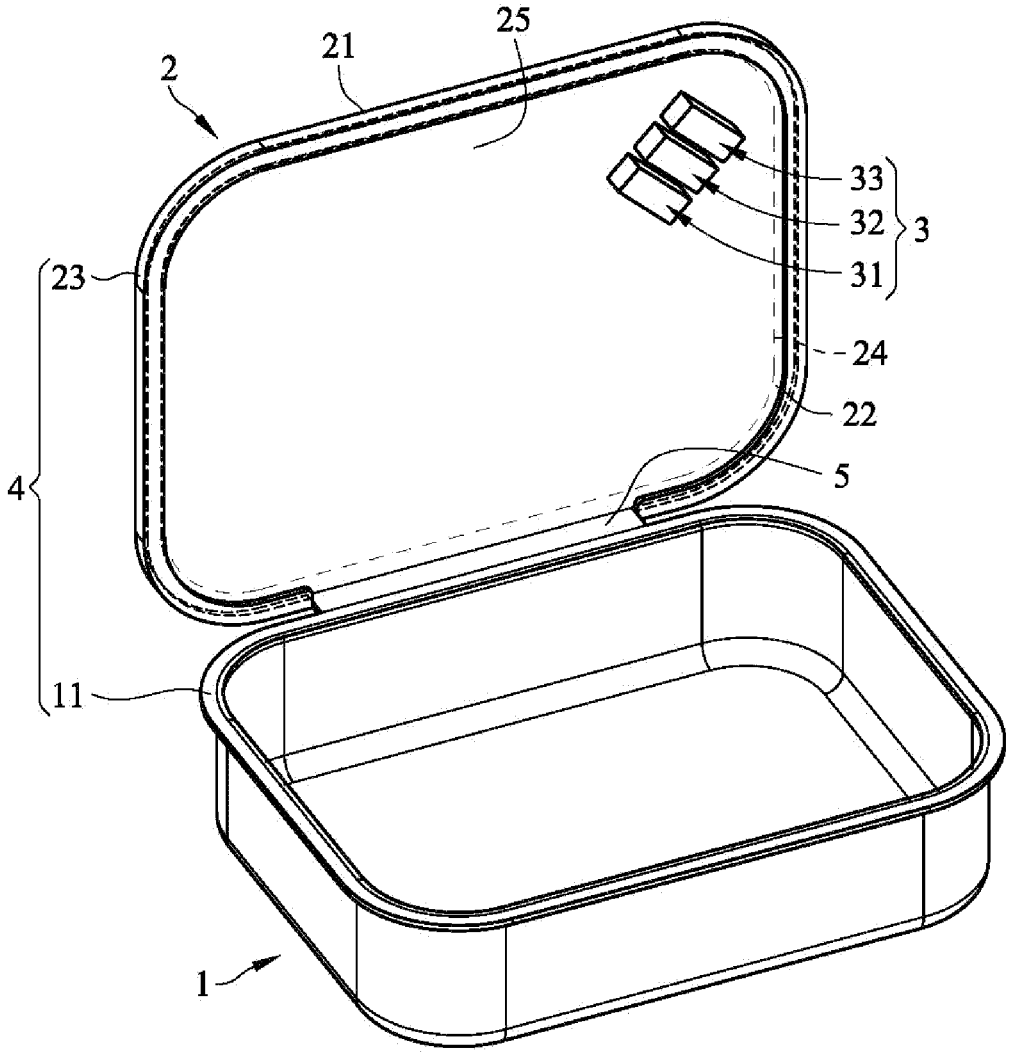
FIG. 4 illustrates a schematic diagram of another embodiment of the tamper-evident container of the invention.

Please refer to FIGS. 1 to 4, in which FIG. 1 illustrates a schematic diagram of an embodiment of the tamper-evident container of the invention; FIG. 2 illustrates another schematic diagram of the tamper-evident container shown in FIG. 1; FIG. 3 illustrates an in-use state of the tamper-evident container shown in FIG. 1; and FIG. 4 illustrates a schematic diagram of another embodiment of the tamper-evident container of the invention, in which a tamper-evident container 100 includes a container body 1, a lid 2 and a force application structure 3.

As shown in FIG. 1, the container body 1 includes a protruding buckle portion 11, where the protruding buckle portion 11 is formed at the outer edge of the top of the container body 1; the accommodating space in the container body 1 can accommodate food; and the shape of the container body 1 can be semicircular or approximately rectangular.

As shown in FIGS. 1 and 2, the lid 2 includes a top surface 21, a bottom surface 22, a buckle portion 23 and a breakable line 24, where the buckle portion 23 is provided on the periphery of the lid 2 for buckling with the protruding buckle 11 to form a locking structure 4, so that the container body 1 and the lid 2 can be tightly engaged with each other.

As shown in FIG. 2, the breakable line 24 presents a single dotted line surrounding the lid 2. A user can see the breakable line 24 both on the top surface 21 and the bottom surface 22 of the lid 2. In addition, the breakable line 24 encloses an area 25 in the lid 2, which can be of a spoon shape, a water-drop shape, a rectangular shape, or an irregular shape.

In addition, the force application structure 3 includes a first groove 31, a second groove 32, and a third groove 33, where the first groove 31, the second groove 32, and the third groove 33 are all recessed from the top surface 21 of the lid 2, and the shape thereof can be rectangular, semicircular, semi-elliptical or other geometric shapes; the first groove 31, the second groove 32, and the third groove 33 are arranged with intervals of D; and the force application structure 3 is arranged at at least one location within the area 25.

As shown in FIG. 3, the force applying structure 3 can be pulled up or pressed down by an external force to separate the area 25 from the lid 2. To be specific, by pulling up or pressing down the force applying structure 3 to break the breakable line 24, the area 25 enclosed by the breakable line 24 can thereby be removed from the lid 2 to make the contents in the tamper-evident container 100 accessible for the user.

In addition, as shown in FIG. 4, the tamper-evident container 100 of the present invention may further include a solid bending line 5. The solid bending line 5 is implemented on one side of the tamper-evident container 100 so that the container body 1 is connected with the one side of the lid 2.

Figure 5:
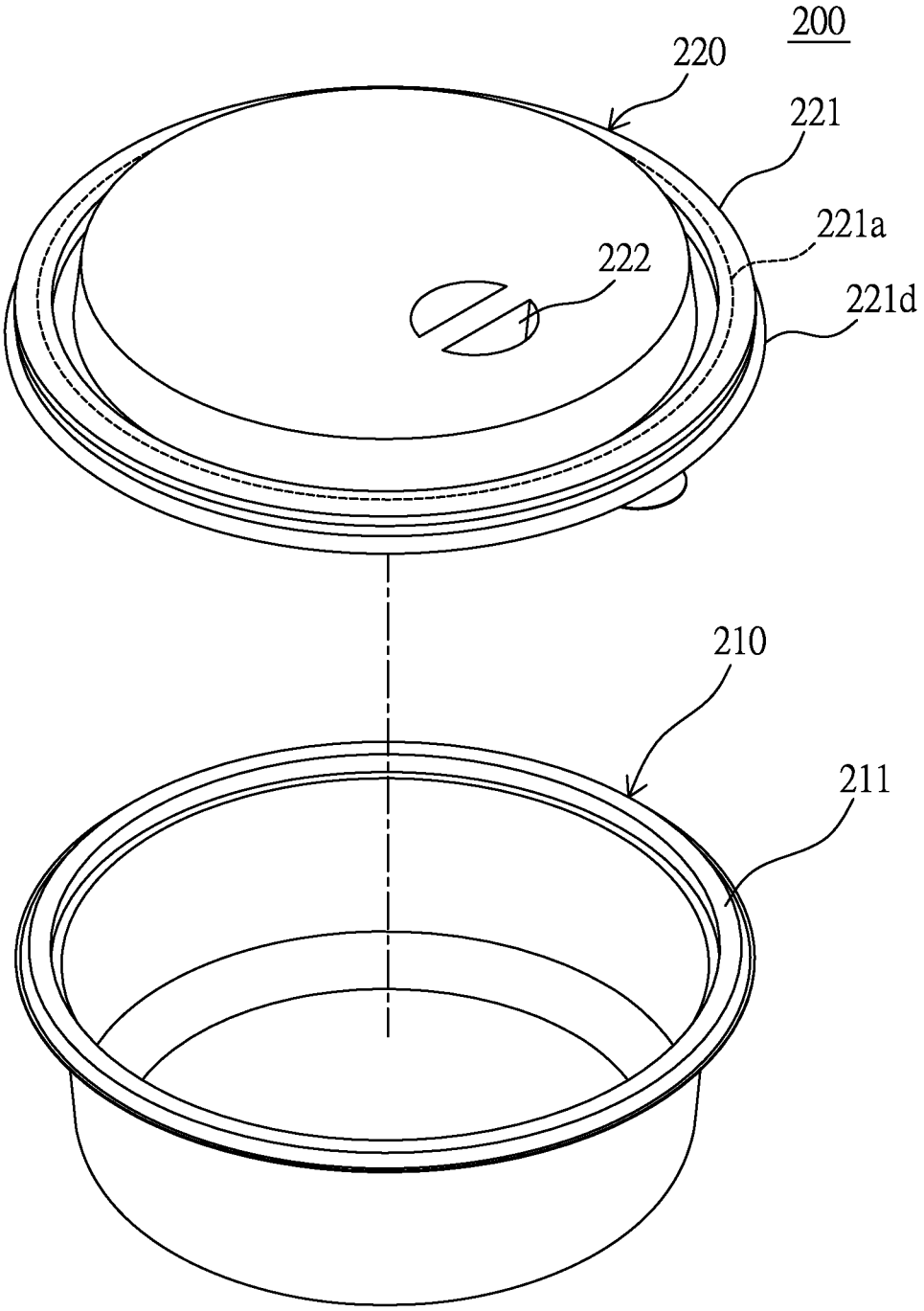
FIG. 5 illustrates an exploded diagram of another embodiment of the tamper-evident container of the present invention.
Figure 6:
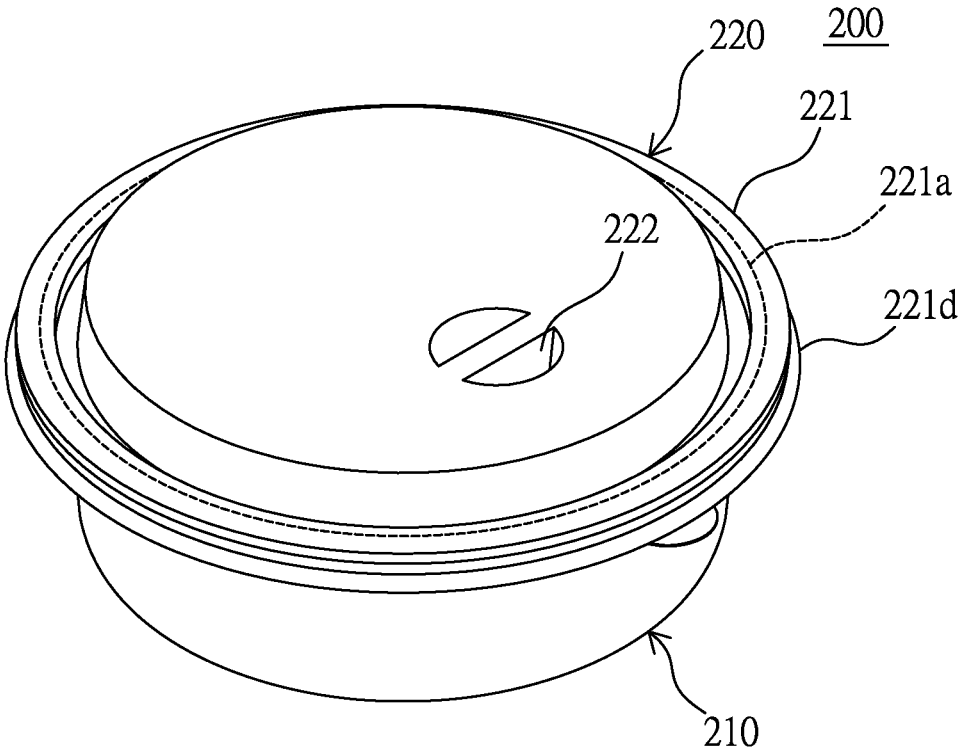
FIG. 6 illustrates an assembled diagram of the tamper-evident container shown in FIG. 5.

In addition, please refer to FIG. 5 and FIG. 6, where FIG. 5 illustrates an exploded diagram of another embodiment of the tamper-evident container of the present invention; and FIG. 6 illustrates an assembled diagram of the tamper-evident container shown in FIG. 5.

As shown in FIG. 5 and FIG. 6, a tamper-evident container 200 includes a container body 210 and a lid 220, where the container body 210 and the lid 220 can be made of plastic, and the container body 210 can be a transparent container.

Figure 7:
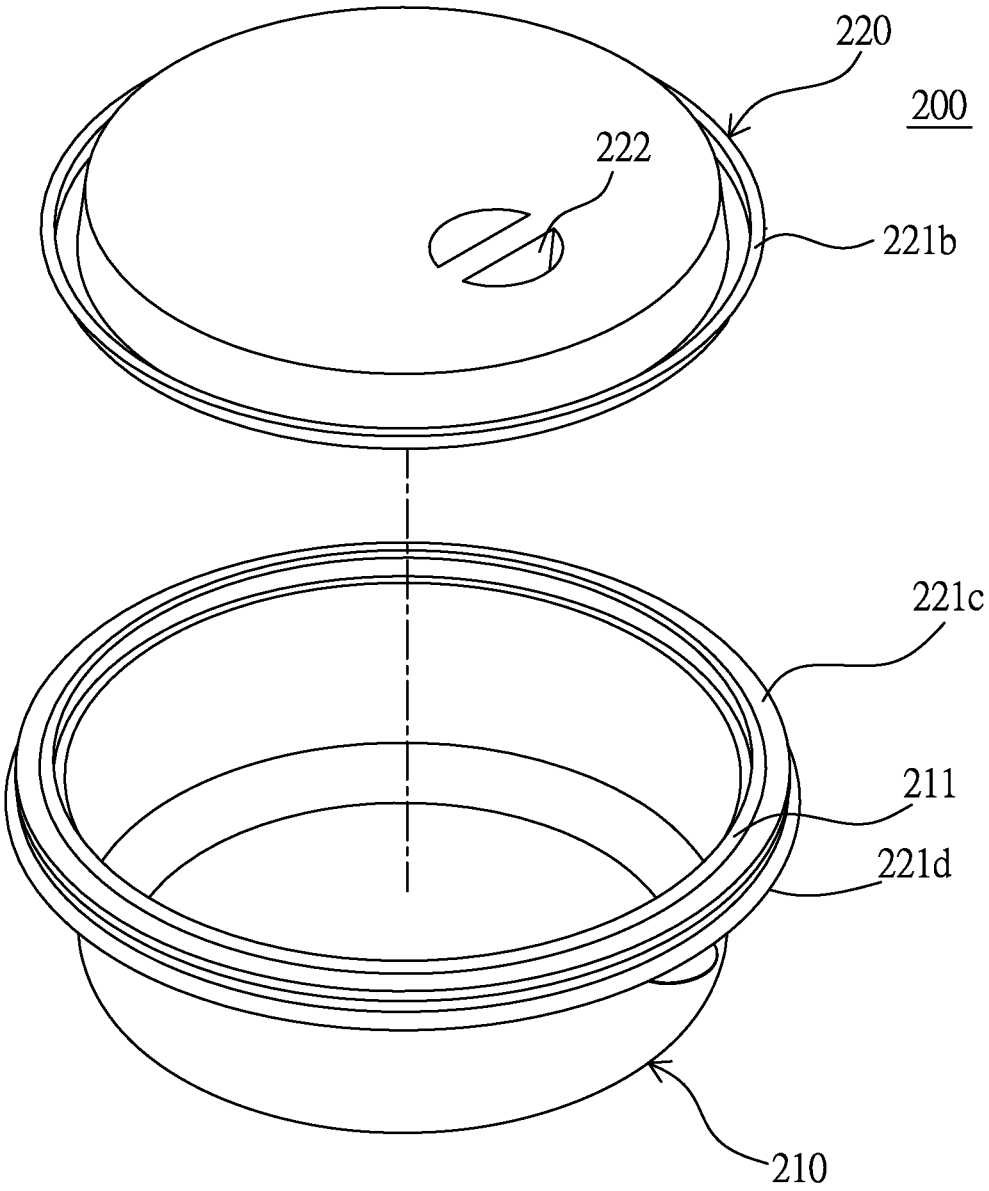
FIG. 7 is a schematic diagram of the tamper-evident container of FIG. 5 being separated into two parts after the loop-shaped breakable line 221*a* is broken.

The periphery of the opening of the container body 210 has a first hollow convex loop 211; the lid 220 has a second hollow convex loop 221 and a force application structure 222, where the second hollow convex loop 221 is used to engage with the first hollow convex loop 221, and a loop-shaped breakable line 221*a* is provided on a loop-shaped top surface of the second hollow convex loop 221, and the force application structure 222 is located in the area surrounded by the second hollow convex loop 221 and has multiple concave or convex structures for a legitimate user to pull up or press down to break the loop-shaped breakable line 221*a*, so that the area enclosed by the loop-shaped breakable line 221*a* can be removed from the lid 220, thereby making the contents in the tamper-evident container 200 accessible. Please refer to FIG. 7, which is a schematic diagram of the tamper-evident container 200 being separated into two parts after the loop-shaped breakable line 221*a* is broken, where the second hollow convex loop 221 is divided into two parts: a first loop-shaped convex edge 221*b* remaining on the lid 220 and a second loop-shaped convex edge 221*c* rest on the first hollow convex loop 211. The second hollow convex loop 221 has an outer peripheral flange 221*d* located on an outermost peripheral edge of the second hollow convex loop 221 and positioned parallel with a top surface of the lid 220. The outer peripheral flange 221*d* extends outwardly and horizontally beyond the container body 210. As the first loop-shaped convex edge 221*b* can still rest onto the first hollow convex loop 211, therefore, the lid 220 can still cover the container 210 when necessary.

Figure 8:
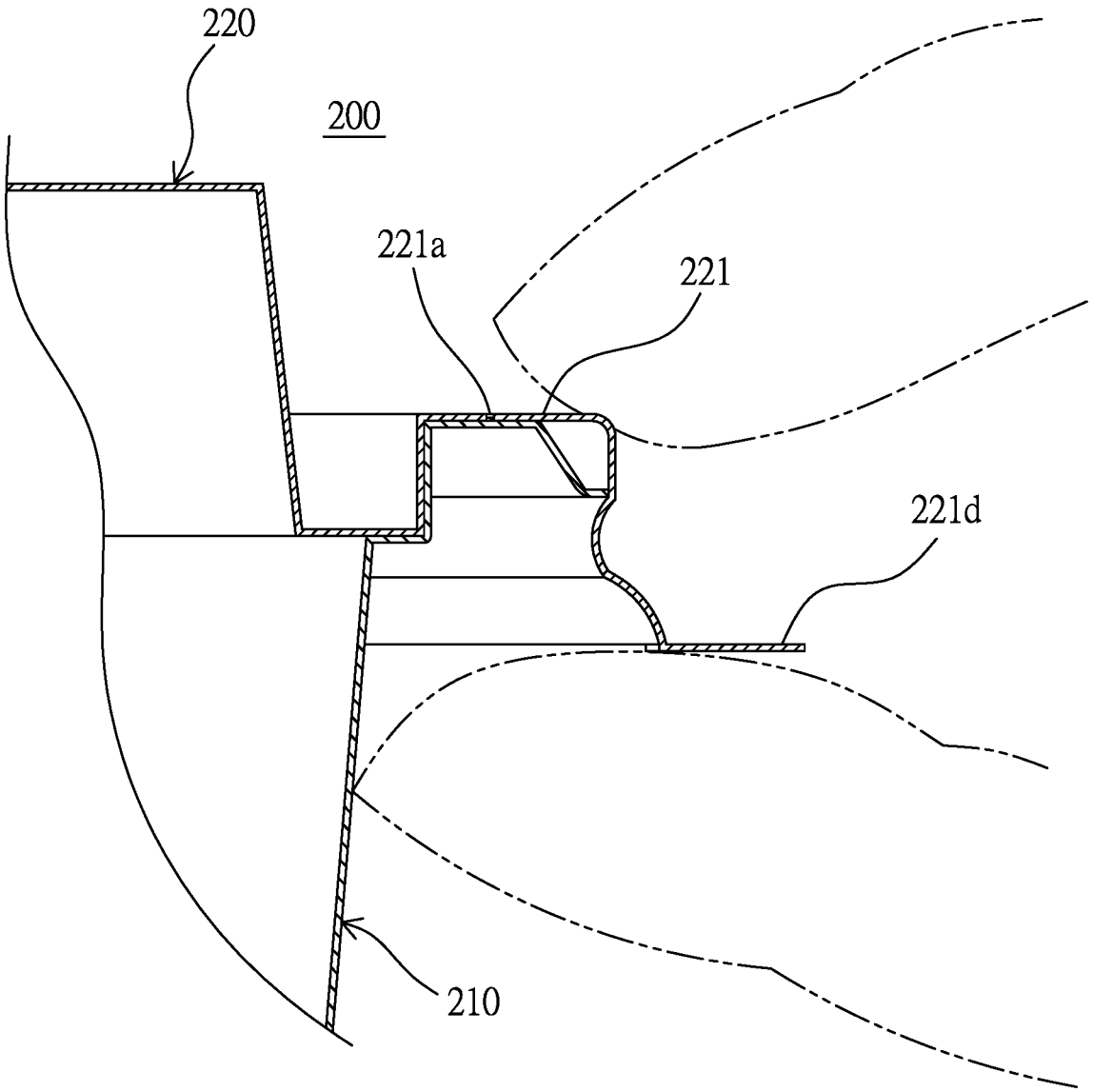
FIG. 8-9 are schematic diagrams of a partial break of the loop-shaped breakable line caused by an illegitimate person opening up a local peripheral edge of the tamper-evident container shown in FIG. 5.
Figure 9:
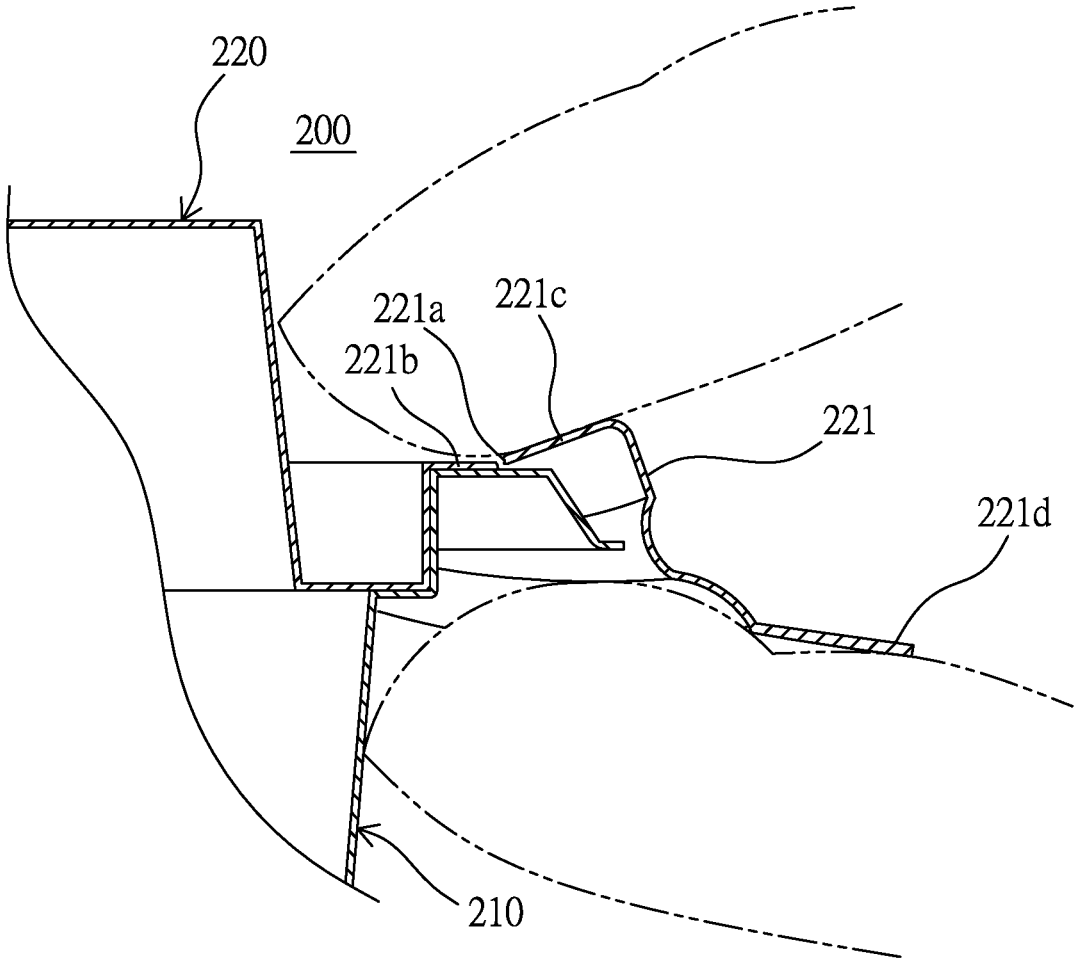

In addition, it is to be particularly pointed out here that when a meal packager wants to connect the container body 210 with the lid 220, the second hollow convex loop 221 can be engaged or sleeved with the first hollow convex loop 211. After that, if someone (for example, a delivery person) intends to secretly open the lid 220 through the periphery of the lid 220, since the second hollow convex loop 221 and the first hollow convex loop 211 are in a sleeved and engaging state, therefore, the action of secretly opening the lid 220 through the periphery of the lid 220 will generate stress in a corresponding area of the loop-shaped breakable line 221*a* and break the corresponding area. To be more specific, when an illegitimate person performs an opening action from any local area of the second hollow convex loop 221 of the lid 220 to cause an upward displacement of the local area exceeding a threshold, a corresponding local area of the loop-shaped breakable line 221*a* will be broken to show that the tamper-evident container 200 has been tampered with. The mentioned scenario is illustrated in FIG. 8 and FIG. 9.

In addition, although the container body 210 is circular in this embodiment, the invention is not limited thereto, the container body 210 can also be of other geometric shapes, such as triangles, quadrilaterals, and other polygons.

With the designs disclosed above, the tamper-evident container of the invention can therefore provide the following advantages:

1. The tamper-evident container of the invention, by installing a loop-shaped breakable line around the periphery of the container, can leave evidence at any part of the periphery of the container when that part of the periphery is opened by an illegitimate person.

2. The tamper-evident container of the invention can facilitate a legitimate user to open a lid of the container by providing a force application structure in the middle area of the lid for the legitimate user to apply a longitudinal force thereon to break the loop-shaped breakable line to open the lid.

3. The tamper-evident container of the invention can let the main part of the lid be able to rest on and lid the opening of the container body after the loop-shaped breakable line is broken and the periphery part of the lid outside the loop-shaped breakable line is removed.

While the invention has been described by way of example and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

In summation of the above description, the present invention herein enhances the performance over the conventional structure and further complies with the patent application requirements and is submitted to the Patent and Trademark Office for review and granting of the commensurate patent rights.

What is claimed is:

1. A tamper-evident container, comprising:

a container body having a first hollow convex loop that surrounds a periphery of an opening thereof; and a lid having a second hollow convex loop and a force application structure, wherein the second hollow convex loop surrounds a peripheral edge of the lid and is used to engage with the first hollow convex loop, the force application structure is located in an area surrounded by the second hollow convex loop, and a loop-shaped breakable line is provided on a middle of a loop-shaped topmost surface of the second hollow convex loop that surrounds a peripheral edge of the lid;

wherein, when the lid is positioned on the container body and the loop-shaped breakable line is located in a pre-broken position, the second hollow convex loop engages and is located on an exterior of a top and an outermost peripheral edge of the first hollow convex loop of the container body, the top and the outermost peripheral edge of the first hollow convex loop being spaced apart, the top and the outermost peripheral edge of the first hollow convex loop of the container body are located entirely within the second hollow convex loop of the lid, the second hollow convex loop has an outer peripheral flange located on an outermost peripheral edge of the second hollow convex loop and positioned parallel with a top surface of the lid, the outer peripheral flange extends outwardly and horizontally beyond the container body, the loop-shaped breakable line and the second hollow convex loop are located entirely outside the container body and cover an outer most part of the opening and the first hollow convex loop of the container body and the outer peripheral flange extends outwardly and horizontally beyond the container body;

wherein, when in a normal opening operation, the force application structure is used for a user to apply a longitudinal force of pull or press thereon to break the loop-shaped breakable line located on the middle of the loop-shaped topmost surface of the second hollow convex loop, and the tamper-evident container provides an effective lever structure formed between the force application structure and the loop-shaped breakable line, the effective lever structure having a fulcrum at a foot of an inner wall of the first hollow convex loop, and a lever arm for the force application structure being much larger than a lever arm for the loop-shaped breakable line, so that an area enclosed by the loop-shaped breakable line can be easily removed from the lid; and when an illegitimate user applies a lifting force on any local area of the second hollow convex loop of the lid to make the local area moving upward with a displacement exceeding a threshold to separate the second hollow convex loop of the lid from the outermost peripheral edge of the first hollow convex loop of the container body, a corresponding local area of the loop-shaped breakable line will be broken to show that the tamper-evident container has been tampered with.

2. The tamper-evident container as disclosed in claim 1, wherein the lid is made of plastic.

3. The tamper-evident container as disclosed in claim 1, wherein the container body is made of plastic.

4. The tamper-evident container as disclosed in claim 1, wherein the container body is transparent.

5. The tamper-evident container as disclosed in claim 1, wherein the container body has a shape of circle or polygon.

* * * * *